United States Patent [19]

Green et al.

[11] 4,048,054

[45] Sept. 13, 1977

[54] LIQUEFACTION OF COAL

[75] Inventors: Robert C. Green, Berkeley Heights; Robert L. Dubell, Florham Park, both of N.J.

[73] Assignee: Exxon Research and Engineering Company, Linden, N.J.

[21] Appl. No.: 707,964

[22] Filed: July 23, 1976

[51] Int. Cl.[2] ..... C10G 1/06

[52] U.S. Cl. ..... 208/8

[58] Field of Search ..... 208/8

[56] References Cited

U.S. PATENT DOCUMENTS

| | | | |
|---|---|---|---|
| 3,505,203 | 4/1970 | Nelson | 208/8 |
| 3,645,885 | 2/1972 | Harris et al. | 208/8 |
| 3,700,583 | 10/1972 | Salamony et al. | 208/8 |
| 3,726,784 | 4/1973 | Correa et al. | 208/8 |
| 3,726,785 | 4/1973 | Keller et al. | 208/8 |

*Primary Examiner*—Delbert E. Gantz
*Assistant Examiner*—James W. Hellwege
*Attorney, Agent, or Firm*—James E. Reed

[57] ABSTRACT

In a coal liquefaction process wherein feed coal is contacted with molecular hydrogen and a hydrogen-donor solvent in a liquefaction zone to form coal liquids and vapors and coal liquids in the solvent boiling range are thereafter hydrogenated to produce recycle solvent and liquid products, the improvement which comprises separating the effluent from the liquefaction zone into a hot vapor stream and a liquid stream; cooling the entire hot vapor stream sufficiently to condense vaporized liquid hydrocarbons; separating condensed liquid hydrocarbons from the cooled vapor; fractionating the liquid stream to produce coal liquids in the solvent boiling range; passing the cooled vapor, the coal liquids in the solvent boiling range, and makeup hydrogen to the solvent hydrogenation zone as feed to the hydrogenation zone; and thereafter catalytically hydrogenating the hydrogenation zone feed stream while quenching the hydrogenation reaction with fluids recovered from the hydrogenation zone effluent.

10 Claims, 1 Drawing Figure

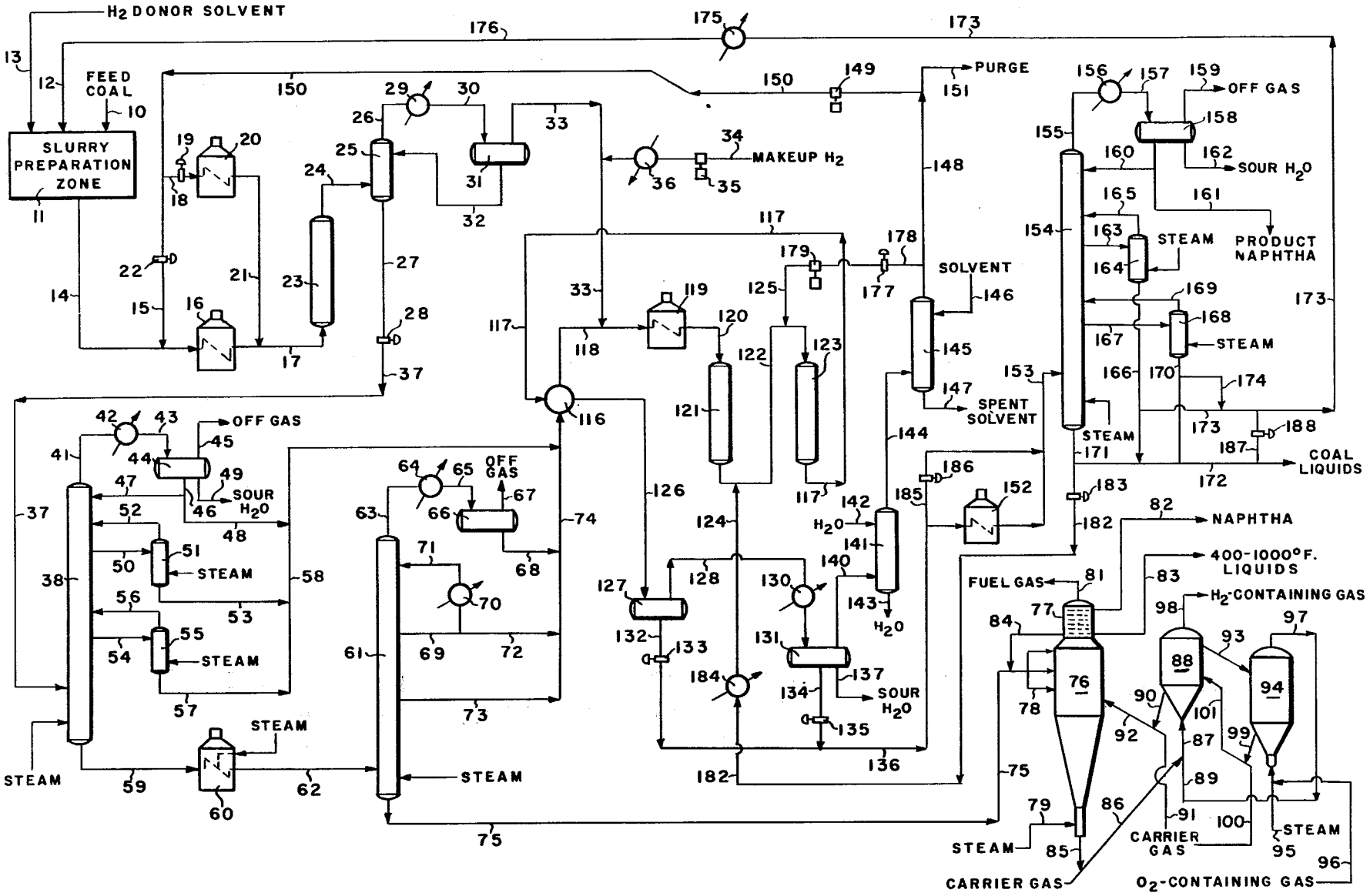
H2 DONOR SOLVENT
FEED COAL
SLURRY PREPARATION ZONE
OFF GAS
SOUR H2O
PRODUCT NAPHTHA
STEAM
COAL LIQUIDS
NAPHTHA
400-1000°F. LIQUIDS
H2-CONTAINING GAS
O2-CONTAINING GAS
CARRIER GAS
FUEL GAS
PURGE
SOLVENT
SPENT SOLVENT
MAKEUP H2
H2O

LIQUEFACTION OF COAL

BACKGROUND OF THE INVENTION

1. Field of the Invention

This invention relates to the liquefaction of coal or similar liquefiable carbonaceous solids and is particularly concerned with hydrogen-donor solvent liquefaction processes in which liquids produced by the treatment of feed coal or similar solids with molecular hydrogen and a hydrogen-donor solvent are subsequently hydrogenated to produce recycle solvent and additional liquid products.

2. Description of the Prior Art

Coal liquefaction processes in which the feed coal is first contacted with molecular hydrogen and a hydrogen-donor solvent in a liquefaction zone at elevated temperature and pressure and a portion of the liquid product is then catalytically hydrogenated in a solvent hydrogenation zone to generate solvent for recycle to the liquefaction step and produce additional liquid products show promise as a means for the production of liquid hydrocarbons from coal. In such processes, hydrogenation of the liquid in the solvent boiling range is generally carried out at a pressure similar to or somewhat lower than that employed in the liquefaction zone and at a somewhat lower temperature. To supply the heat required to raise the solvent boiling range liquid to the hydrogenation temperature, it has been proposed that all of the vaporous product taken overhead from the liquefaction zone be passed directly to the solvent hydrogenation zone without cooling and that the quantity of coal liquids and recycle hydrogen which is mixed with the vaporous product and fed to the hydrogenation zone be adjusted so that the combined feed stream is maintained at the required hydrogenation temperature. This eliminates the need for a furnace to preheat the feed stream. Because the hydrogenation reaction is exothermic, additional cold feed is introduced into the hydrogenation zone downstream of the initial inlet point to quench the reaction and at the same time heat this additional feed to the necessary hydrogenation temperature.

The process described above has advantages over earlier processes from the standpoint of conserving thermal energy but poses certain operational problems which tend at least in part to offset the heat conservation advantage. The use of the liquefaction vapors to provide all of the heat needed to raise the initial increment of the liquid feed to the hydrogenation temperature and thus eliminate the need for a furnace limits the ratio in which the liquid and vapor can be introduced into the initial stage of the hydrogenation zone and imposes restrictions with respect to the hydrogen partial pressure in the initial stage. The cold feed introduced downstream of the initial stage has a shorter residence time within the hydrogenation zone than the feed introduced initially and hence uniform hydrogenation to achieve maximum solvent and product yields may be difficult to obtain. Overhydrogenation may sometimes occur. In addition, the introduction of relatively cold feed into the reaction zone at one or more points downstream of the initial inlet makes effective contacting of the feed and hydrogen more difficult to achieve, may promote product degradation and the production of excessive quantities of gas and low molecular weight hydrocarbons, and makes the overall reaction difficult to control. As a result of these and related disadvantages, the overall efficiency of such a process may leave much to be desired.

SUMMARY OF THE INVENTION

The present invention provides an improved process for the preparation of liquid products from coal or similar liquefiable carbonaceous solids which at least in part avoids the difficulties referred to above and has advantages over liquefaction processes proposed in the past. In accordance with the invention, it has now been found that hydrogenated liquid products can be produced from bituminous coal, subbituminous coal, lignite and similar feed materials by first treating the coal or other solid feed material at elevated temperature and pressure with molecular hydrogen and a hydrogen-donor solvent in a noncatalytic liquefaction zone, separating the effluent from the liquefaction zone into a hot vapor stream and a liquid stream, cooling the entire hot vapor stream sufficiently to condense vaporized liquid hydrocarbons, separating condensed liquid hydrocarbons from the cooled vapor, fractionating said liquid stream to produce liquids in the solvent boiling range, and thereafter passing the cooled vapor, makeup hydrogen, and liquids in the solvent boiling range recovered from the liquid stream to the solvent hydrogenation zone as solvent hydrogenation feed.

As indicated above, the liquid stream recovered from the liquefaction zone effluent is fractionated to produce a gaseous fraction, a distillate fraction including constituents within the donor-solvent boiling range, and a bottoms fraction boiling in excess of about 1000° F. The distillate fraction is preheated by indirect heat exchange with the effluent from the solvent hydrogenation zone and then mixed with the vapor and makeup hydrogen before it is used as solvent hydrogenation feed. The mixed solvent hydrogenation feed stream thus prepared may be passed through a preheat furnace and heated to the hydrogenation reaction temperature if desired. Only a relatively small increase in temperature is generally needed at this point and hence in most cases the preheat furnace can be dispensed with. The heavy 1000° F.+ bottoms product recovered from the liquefaction zone effluent is passed through a coking zone or the like for upgrading into more valuable products.

The solvent hydrogenation feed prepared as described above is introduced into the solvent hydrogenation zone, preferably a multistage reaction provided with means for introducing a quench between stages, and hydrogenation takes place in the presence of a hydrogenation catalyst. The effluent from this hydrogenation zone is passed in indirect heat exchange with the distillate containing solvent boiling range constituents and then separated, preferably at hydrogenation pressure, into a vapor fraction composed primarily of hydrogen and normally gaseous hydrocarbons and a liquid fraction. The vapor fraction is treated for the removal of acid gases and the like and may be in part recycled to the hydrogenation zone, preferably between stages, for use as a gaseous quench. A portion of the vapor fraction is purged from the system. The remaining vapor is recycled for introduction into the coal-solvent slurry fed to the liquefaction zone. The liquid stream separated from the hydrogenation zone effluent is fractionated to produce overhead gases and naphtha and a heavier fraction which may be in part recycled to the hydrogenation zone for introduction between stages as a liquid quench in lieu of the gaseous quench. The remainder of the heavier fraction is recycled to the slurry preparation zone or withdrawn as product.

As indicated above, the process of the invention can be carried out with either a gaseous or a liquid quench. If a gaseous quench is used, the liquid stream recovered from the hydrogenation zone effluent can be passed directly to a stripper for the removal of light ends. No preheat furnace or sidestream strippers need be provided unless two or more sidestream and bottoms products are desired. If a liquid quench is used, on the other hand, a preheat furnace and fractionating tower equipped with sidestream strippers will be employed to fractionate the liquids from the solvent hydrogenation effluent. The bottoms from this tower will be employed for quench purposes and the sidestreams will be used as a source of recycle solvent. A portion of both the bottoms and sidestreams can be withdrawn as coal liquids product if coal liquids have not been recovered earlier.

The process of the invention has advantages over earlier processes in that it results in better heat integration of the liquefaction and solvent hydrogenation steps of the process, reduces the number of recycle steps which must be employed, alleviates difficulties that might otherwise be encountered as a result of the nonuniform hydrogenation of coal liquids produced in the liquefaction zone, reduces the likelihood of hydrocracking and other undesirable reactions in the hydrogenation zone, simplifies process control problems, permits greater process flexibility, and has other benefits. As a result of these advantages, the process of the invention may have widespread application.

BRIEF DESCRIPTION OF THE DRAWING

The drawing is a schematic flow diagram of a process for the production of hydrogenated liquid products from coal carried out in accordance with the invention.

DESCRIPTION OF THE PREFERRED EMBODIMENTS

In the process shown in the drawing, feed coal is introduced through line 10 into a slurry preparation zone 11 from a coal storage or feed preparation zone which is not shown. This coal is combined with a preheated hydrogen-donor solvent introduced through line 12 to form a slurry. The coal employed will normally consist of solid particles of bituminous coal, subbituminous coal, lignite or a mixture of two or more such materials having a particle size on the order of about one-fourth inch or greater along the major dimension. It is generally preferred to crush and screen the coal to a particle size of about 8 mesh or smaller on the U.S. Sieve Series Scale and then dry the coal particles to remove excess water, either by conventional techniques before the solids are mixed with the solvent in the slurry preparation zone or by mixing the wet solids with hot solvent at a temperature above the boiling point of water, preferably between about 250° F. and about 350° F., to vaporize any excess water present. The moisture in the feed slurry will preferably be reduced to less than about 2 weight percent. The hydrogen-donor solvent required for initial startup of the process and any makeup solvent that may be needed can be added to the system through line 13. The process is generally operated to produce an excess of liquid hydrocarbons in the donor solvent boiling range and hence the addition of significant quantities of makeup solvent is ordinarily not required.

The hydrogen-donor solvent employed to prepare the coal-solvent slurry will normally be a coal-derived solvent, preferably a hydrogenated recycle solvent containing at least 20 weight percent of compounds which are recognized as hydrogen donors at the elevated temperatures of from 700° to about 900° F. which are generally employed in coal liquefaction operations. Solvents containing at least 50 weight percent of such compounds are preferred. Representative compounds of this type include indane, $C_{10}$–$C_{12}$ tetrahydronaphthalenes, $C_{12}$ and $C_{13}$ acenaphthenes, di-, tetra-, and octahydroanthracenes, tetrahydroacenaphthenes, crysene, phenanthrene, pyrene and other derivatives of partially saturated aromatic compounds. Such solvents have been described in the literature and will be familiar to those skilled in the art. The solvent composition produced by the hydrogenation of hydrocarbons produced in the process will depend in part upon the particular coal used as the feedstock to the process, the process steps and operating conditions employed for liquefaction of the coal, the particular boiling range fraction selected for hydrogenation, and the hydrogenation conditions employed within the hydrogenation zone. In the slurry preparation zone 11, the incoming feed coal is normally mixed with solvent recycled through line 12 in a solvent-to-coal ratio of from about 0.8:1 to about 2:1. Ratios of from about 1:1 to about 1.7:1 are in most cases preferred.

The slurry of coal and solvent which is prepared in zone 11 as described above is withdrawn through line 14 and introduced, together with vapor recycled through line 15, into mixed phase preheat furnace 16 where the feed materials are heated to a temperature within the range between about 750° F. and about 950° F. The mixture of hot slurry and vapor withdrawn from the furnace through line 17 will ordinarily contain from about 1 to about 8 weight percent, preferably from about 2 to about 5 weight percent, of molecular hydrogen on a moisture and ash-free basis. In lieu of mixing the slurry and recycle vapor or treat gas prior to preheating in the furnace as described above, the vapor can be passed through line 18 containing valve 19, separately preheated in furnace 20, and thereafter passed through line 21 for addition to the hot slurry in line 17. If this procedure is used, valve 19 will normally be open and valve 22 in line 15 will normally be closed. This use of separate preheat furnaces for the slurry and treat gas has advantages in some cases and is often preferred. If two furnaces are provided, a portion of the recycle vapor or treat gas can be preheated in each of the furnaces if desired.

The hot slurry containing recycled vapor or treat gas is fed from line 17 into liquefaction reactor 23 which is maintained at a temperature between about 750° F. and about 950° F., preferably between about 825° F. and about 875° F., and at a pressure between about 1000 psig and about 3000 psig, preferably between about 1500 and about 2500 psig. A single upflow liquefaction reactor is shown in the drawing but a plurality of reactors arranged in parallel or series can be employed if desired. The liquid residence time within reactor 23 will normally range between about 5 minutes and about 100 minutes and will preferably be from about 10 to about 60 minutes. Within the liquefaction zone, high molecular weight constituents of the coal are broken down and hydrogenated to form lower molecular weight gaseous, vapor and liquid products. The hydrogen-donor solvent contributes hydrogen atoms which react with organic radicals liberated from the coal and prevent their recombination. The hydrogen in the recycle vapor stream injected with the slurry serves as replacement hydrogen for depleted hydrogen-donor molecules in the solvent and results in the formation of additional donor solvent molecules by in situ hydrogenation. Process conditions within the liquefaction zone are selected to insure the generation of sufficient hydrogen-donor precursors and at the same time provide sufficient liquid product for proper operation of the solvent hydrogenation zone in the process. The conditions employed in the liquefaction reactor may be varied as necessary to achieve these objectives.

The effluent from coal liquefaction zone 23 is taken overhead from the liquefaction reactor through line 24. This effluent stream will normally include gaseous liquefaction products such as carbon monoxide, carbon dioxide, ammonia, hydrogen, hydrogen chloride, hydrogen sulfide, methane, ethane, ethylene, propane, propylene, naphtha, and the like; unreacted hydrogen from the feed slurry; solvent boiling range hydrocarbons; and heavier liquefaction products including solid liquefaction residues. This effluent stream is passed to reactor effluent separator 25 where it is separated at substantially liquefaction pressure and at a temperature only slightly below that in the liquefaction reactor into an overhead hot vapor stream which is withdrawn through line 26 and a liquid stream taken off through line 27 containing a pressure letdown valve 28. The vapor stream in line 26, at a temperature between about 700° and about 900° F., is passed through heat exchanger 29 where it is cooled to a temperature from about 50° to 200° F. below the liquefaction temperature and then introduced through line 30 into liquefaction separator 31. Here a portion of the liquids boiling within the range between about 450° and about 850° F., together with lesser amounts of heavier materials and some dissolved gases and naphtha boiling range constituents, is separated from the vapor and returned to the reactor effluent separator 25 through line 32 as a wash oil. The amount of wash oil thus returned may vary from about 5% to about 25% of the total feed to separator 31 and will normally be sufficient to minimize solids entrainment in the vapor leaving the liquefaction reactor effluent separator. The vapor from separator 31 is taken overhead through line 33 at a temperature on the order of from about 50° to about 200° F. below the liquefaction temperature and at a pressure only slightly below that in the liquefaction reactor. This vapor stream will contain hydrogen as the principal constituent but will also include significant quantities of methane and other normally gaseous hydrocarbons and lesser amounts of hydrocarbon liquids boiling up to about 850° F. Hydrogen chloride, hydrogen sulfide, ammonia, carbon dioxide and the like will also be present. Makeup hydrogen introduced through line 34, raised to hydrogenation pressure in compressor 35, and heated in exchanger 36 is added to the cooled vapor stream prior to its use as feed to the solvent hydrogenation stage of the process. The ratio of vapor to makeup hydrogen may be varied over a considerable range but will generally range between about 0.5 and about 1.5 moles of vapor per mole of makeup hydrogen gas.

The hot liquid stream withdrawn from liquefaction reactor effluent separator 25 through line 27 passes through pressure reduction valve 28 where the pressure is reduced to about 100 psia or less. This stream is then fed through line 37 into atmospheric fractionation unit 38. Here the feed is fractionated and an overhead fraction composed primarily of gases and naphtha constituents boiling up to about 400° F. is withdrawn through line 41. This overhead fraction is cooled in exchanger 42 and passed through line 43 to fractionator distillate drum 44 where the gases are taken off overhead through line 45. These gases, composed primarily of hydrogen and normally gaseous hydrocarbons, can be employed as a fuel gas, for the generation of process heat, or used for other purposes. Liquid hydrocarbons separated from the overhead gas are withdrawn through line 46 and a portion of this stream may be returned through line 47 to the upper part of the fractionating column. The remaining liquid may be passed through line 48 for use as feed to the solvent hydrogenation unit. A sour water stream is withdrawn from the distillate drum through line 49 and passed to cleanup facilities which do not appear in the drawing. One or more intermediate fractions boiling within the range between about 250° F. and about 700° F. are withdrawn from the atmospheric fractionator for use as feed to the solvent hydrogenation reactor. It is generally preferred to recover a relatively light fraction composed primarily of constituents boiling below about 500° F. by means of line 50, stripper 51, return line 52, and withdrawal line 53 and to recover a heavier intermediate fraction composed primarily of constituents boiling below about 700° F. by means of line 54, stripper 55, return line 56, and withdrawal line 57. These two intermediate distillate fractions plus naphtha recovered from the overhead stream are passed through line 58 for use as liquid feed to the solvent hydrogenation unit. A portion of one or all of these streams can also be withdrawn from the system as product through a withdrawal line not shown in the drawing if desired. The bottoms fraction from the atmospheric column, composed primarily of constituents boiling in excess of about 700° F. and including unreacted solids and residues, is withdrawn through line 59, heated to a temperature of about 600° to 775° F. in furnace 60, and then introduced into vacuum fractionation unit 61 through line 62. The furnace can in some cases be omitted.

The feed to the vacuum fractionation column is distilled in the column under reduced pressure to permit the recovery of an overhead fraction which is withdrawn through line 63, cooled in heat exchanger 64, and then passed through line 65 into distillate drum 66. Gases and vapors which may be employed as fuel are taken off through line 67 and passed through the vacuum equipment. Liquids are withdrawn through line 68. A heavier intermediate fraction, one composed primarily of constituents boiling below about 850° F. for example, may be recovered by means of line 72 from a pumparound circuit consisting of line 69, heat exchanger 70, return line 71, and line 72. A still heavier sidestream may be withdrawn through line 73, which may also include a pumparound. These three distillate fractions are passed through line 74 and combined with the distillate in line 58 for use as feed to the solvent hydrogenation unit. A part of one or all of these streams can be withdrawn as product through a line not shown in the drawing if desired. A bottoms fraction boiling in excess of about 1000° F. at atmospheric pressure and containing unreacted coal solids and residues is withdrawn from the vacuum fractionation column through line 75 and may be used for the production of additional liquid products and hydrogen as described hereafter or upgraded in other ways.

Any of a number of alternates to the fractionation step described above may be employed if desired. One such alternate, for example, is to pass the liquid stream from the reactor effluent separator to a centrifuge, gravity settling unit, filter or the like for the removal of unreacted coal solids and residues from the liquids prior to fractionation. Antisolvents such as hexane, decalin or certain petroleum hydrocarbon liquids can be added to the liquefaction products to facilitate separation of the unreacted coal and ash residues from the liquids and permit their removal from the system. Processes of this type have been described in the literature and will be familiar to those skilled in the art. The liquids remaining following the solids separation step can then be separated by fractionation into a naphtha fraction, one or more intermediate streams to be fed to the solvent hydrogenation reactor, and if desired a heavier fraction which can be upgraded by hydrocracking and other downstream processing techniques.

Another alternate procedure which may in some cases be advantageous is to pass the liquid stream from the reactor effluent separator through a line not shown in the drawing to a coking unit associated with the process for upgrading of the liquid by pyrolysis, thermal cracking and other reactions. The coking unit will normally include a coker fractionation tower in which the vaporized product from the coker is distilled to produce an overhead gas stream, a naphtha stream, one or more intermediate fractions useful as feed to the solvent hydrogenation stage of the process, and a heavier bottoms fraction which can be recycled for the production of additional liquids and coke. The coking unit will produce coke which can be subsequently gasified to produce hydrogen or employed for other purposes. Still other modifications in the initial handling of the liquid product from the reactor effluent separator which may be employed to produce solvent hydrogenation reactor feed and other products suitable for upgrading will suggest themselves to those skilled in the art.

The system shown in the drawing includes an integrated coking system containing a fluidized bed coker, a heater, and an associated gasifier. In this system, the hot liquefaction bottoms from the vacuum fractionator are passed through line 75 into fluidized bed coking unit 76. This unit will normally be provided with an upper scrubbing and fractionation section 77 from which liquid and gaseous products produced as a result of the coking reactions can be withdrawn. The unit will generally also include one or more internal cyclone separators or similar devices not shown in the drawing which serve to remove entrained particles from the upflowing gases and vapors entering the scrubbing and fractionation section and return them to the fluidized bed below. A plurality of feed lines 78 will ordinarily be provided as shown to obtain better distribution of the feed material within the coking zone. This zone contains a bed of fluidized coke particles which are maintained in the fluidized state by means of steam or other fluidizing gas introduced near the bottom of the vessel through line 79. The fluidized bed of coke particles is normally maintained at a temperature between about 1000° F. and about 1500° F. by means of hot char which is introduced into the upper part of the reaction section of the coker through line 92. The pressure within the reaction zone will generally range between about 10 and about 30 psig but higher pressures can be employed if desired. The optimum conditions in the reaction zone will depend in part upon the characteristics of the particular feed material employed and can readily be determined.

The hot liquefaction bottoms fed into the fluidized bed of the coking unit is sprayed on the surfaces of coke particles in the bed. Here the material is rapidly heated to bed temperatures. As the temperature increases, lower boiling constituents are vaporized and the heavier fractions undergo thermal cracking and other reactions to form lighter products and additional coke on the surfaces of the bed particles. Vaporized products, steam, and entrained solids move upwardly through the fluidized bed and enter the cyclone separators or other devices where solids present in the fluids are rejected. The fluids then move into the scrubbing and fractionation section of the unit where refluxing takes place. An overhead gas stream is withdrawn from the coker through line 81 and may be employed as a fuel or the like. A naphtha side stream is withdrawn through line 82 and may be combined with naphtha produced elsewhere in the process. A heavier liquids fraction having a nominal boiling range between about 400° F. and about 1000° F. is withdrawn as a side stream through line 83 and may be combined with coal liquids produced elsewhere in the process. Heavier liquids boiling above about 1000° F. may be recycled through line 84 to the incoming feed stream.

The coke particles in the fluidized bed in the reaction section of the coker tend to increase in size as additional coke is deposited. These particles gradually move downwardly through the fluidized bed and are eventually discharged from the reaction section through line 85 as a dense phase solids stream. This stream is picked up by steam or other carrier gas and transported upwardly through line 86 and line 87 into fluidized bed heater 88. Here the coke particles are heated to a temperature of from about 50° to about 300° F. above that in the reaction section of the coker by means of hot gases introduced through line 89. Hot solids are withdrawn from the bed of heater 88 through standpipe 90, picked up by steam or other carrier gas introduced through line 91, and returned to the reaction section of the coker through line 92. The circulation rate between the coker and heater is maintained sufficiently high to provide the heat necessary to keep the coker at the required temperature. If desired, additional heat can be provided by the introduction of air or oxygen into the heater through a line not shown in the drawing.

Hot carbonaceous particles are continuously circulated from the fluidized bed in heater 88 through line 93 to fluidized bed gasifier 94. Here the particles are contacted with steam introduced into the lower end of the gasifier through line 95 and with oxygen injected through line 96. The oxygen reacts with carbon in the solids to produce carbon oxides and generate heat. The steam reacts with carbonaceous solids to produce a gas containing hydrogen, carbon monoxide, carbon dioxide and some methane. If desired, an alkali metal or alkaline earth metal gasification catalyst may be employed to catalyze the gasification reaction. The gas produced is taken overhead from the gasifier through line 97 and circulated through line 89 back to the heater where heat is recovered and employed to raise the temperature of coke particles from the coking unit. A hydrogen-rich gas is withdrawn overhead through line 98 and sent to downstream processing equipment where the gas may be shifted over a water-gas shift catalyst to increase the ratio of hydrogen to carbon monoxide, acid gases may be removed, and residual carbon monixide may be catalytically methanated to produce a high purity hydrogen stream suitable for use as makeup hydrogen in the associated liquefaction and solvent hydrogenation steps of the process. Conventional shift, acid gas removal, and methanation procedures can be employed. Solids from the gasifier are withdrawn through standpipe 99, entrained in carrier gas introduced through line 100, and returned to heater 88 through line 101. The solids circulation rate between the heater and gasifier will normally be sufficiently high to maintain the gasifier temperature within the range between about 1200° and about 1800° F. The use of an alkali metal or alkaline earth metal catalyst in the system permits gasification at temperatures below those which would otherwise be required and thus facilitates use of the heater to provide the heat needed for both the coking unit and the gasifier. It is generally preferred to employ such a catalyst and to operate the coking unit and gasifier at temperatures between about 1200° and about 1500° F. and to operate the fluidized bed heater at a temperature between about 1500° and about 1800 F. In lieu of using oxygen in this manner to produce a hydrogen-rich gas, air can be employed and the resulting nitrogen-containing gas can be used as a fuel.

As indicated earlier, the feed to the solvent hydrogenation stage of the process includes liquid hydrocarbons composed primarily of constituents in the nominal 250° to 700° F. boiling range recovered from atmospheric fractionator 38 and heavier hydrocarbons in the nominal 700° to 1000° F. recovered from vacuum fractionator 61. It may also include liquid hydrocarbons of similar boiling range characteristics recovered from associated coking unit 76. The hydrocarbon feed stream to the solvent hydrogenation stage is fed from lines 58 and 74 to heat exchanger 116 where the feed material passes in indirect heat exchange with hot hydrogenated product withdrawn from the solvent hydrogenation reactor through line 117. The mixed feed stream is heated from an initial temperature of from about 100° to about 500° F. to a final temperature of from about 600° to about 700° F. at a pressure of from about 800 to about 3000 psig. The preheated feed stream is withdrawn from the exchanger through line 118 and combined with vapor withdrawn from the liquefaction separator 31 through line 33. This vapor stream will include makeup hydrogen introduced into the system by means of line 34, compressor 35, and heat exchanger 36. Depending upon the amount of makeup hydrogen added, the vapor stream may have a temperature on the order of about 700° to about 900° F. The vapor will normally be of a temperature somewhat higher than that of the liquid stream in line 118 and hence addition of the vapor will further heat the liquid feed. The combined stream may then be passed through solvent hydrogenation reactor preheat furnace 119 and further heated to a temperature up to about 700° to 900° F. if desired. The amount of heat added in the furnace is normally relatively small and hence, depending upon the ratio in which the vapor and liquid feed are mixed and the temperatures of the two streams, in some cases the furnace can be omitted or bypassed. The combined feed stream heated to the solvent hydrogenation temperature is withdrawn from the furnace through line 120 and fed to the solvent hydrogenation unit.

The solvent hydrogenation reactor shown in the drawing is a two-stage downflow unit including an initial stage 121 connected by line 122 to a second stage 123 but reactors of other types can be employed if desired. It is normally preferred to operate the solvent hydrogenation reactor at a pressure and temperature somewhat lower than those in the liquefaction reactor. The temperature, pressure, and space velocity employed will depend to some extent upon the character of the feed stream used, the hydrogenation catalyst selected for the process and other factors. In general, temperatures within the range between about 550° F. and about 850° F., pressures between about 800 psig and about 3000 psig, and space velocities between about 0.3 and about 3 pounds of feed/hour/pound of catalyst are suitable. The hydrogen treat rates should be sufficient to maintain the average reactor hydrogen partial pressure within the range between about 500 and about 2000 psia. It is generally preferred to maintain a mean hydrogenation temperature within the reactor between about 675° F. and about 750° F., a pressure between about 1500 and about 2500 psig, a liquid hourly space velocity between about 1 and about 2.5 pounds of feed/hour/pound of catalyst, and a makeup hydrogen rate sufficient to maintain an average reactor hydrogen partial pressure within between about 900 and about 1600 psia.

Any of a variety of conventional hydrotreating catalysts may be employed in the process of the invention. Such catalysts typically comprise an alumina or silica-alumina support carrying one or more iron group metals and one or more metals from VI-B of the Periodic Table in the form of an oxide or sulfide. Combinations of one or more Group VI-B metal oxides or sulfides with one or more Group VIII metal oxides or sulfides are generally preferred. Representative metal combinations which may be employed in such catalysts include oxides and sulfides of cobalt-molybdenum, nickel-molybdenum-tungsten, cobalt-nickel-molybdenum, nickel-molybdenum, and the like. A suitable catalyst, for example, is a high metal content sulfided cobalt molybdenum-alumina catalyst containing 1 to 10 weight percent of cobalt oxide and from about 5 to 40 weight percent of molybdenum oxide, preferably from 2 to 5 weight percent of the cobalt oxide and from 10 to 30 weight percent of the molybdenum oxide. Other metal oxides and sulfides in addition to those specifically referred to above, particularly the oxides of iron, nickel, chromium, tungsten and the like, can also be used. The preparation of such catalysts has been described in the literature and is well known in the art. Generally, the active metals are added to the relatively inert carrier by impregnation from aqueous solution and this is followed by drying and calcining to activate the catalyst. Carriers which may be employed include activiated alumina, activated alumina-silica, zirconia, titania, bauxite, bentonite, montmorillonite, and mixtures of these and other materials. Numerous commercial hydrogenation catalysts are available from various catalyst manufacturers and can be used.

The hydrogenation reaction taking place within hydrogenation reactors 121 and 123 is an oxothermic reaction in which substantial quantities of heat are liberated. The temperature in the reactor is controlled to avoid overheating and runaway reaction or undue shortening of the catalyst life by controlling the feed temperature and by means of a liquid or gaseous quench stream introduced between the two stages through line 124 or 125. The quantity of quench fluid injected into the system will depend in part upon the maximum temperature to which the catalyst is to be subjected, characteristics of the feed to the reactor, the type of quench used, and other factors. In general, it is preferred to monitor the reaction temperature at various levels in each stage of the reactor by means of thermocouples or the like and regulate the amount of feed and quench admitted so that the temperature does not exceed a predetermined maximum for that particular level. By increasing the amount of feed through line 120 and the amount of quench admitted through line 124 or line 125 whenever the temperature within the reactor becomes too high, the overall reaction temperature can be maintained within predetermined bounds. If the hydrogenation reaction is to be carried out in the lower part of the 550° to 850° F. range, as may be the case when coal liquids of relatively low specific gravity and low sulfur and nitrogen content are being hydrogenated, a somewhat greater increase in temperature may be permissible than would be the case where the hydrogenation reaction is to be carried out in the upper part of the range. Operations of the latter type are frequently used for the hydrogenation of liquid products having relatively high sulfur and nitrogen contents and high specific gravities. The optimum temperature and other conditions for a particular feedstock and catalyst system can be readily determined.

The hydrogenated effluent produced in the solvent hydrogenation unit is withdrawn from the second stage 123 of the unit through line 117 at a temperature of from about 550° to about 850° F., preferably from about 700° to about 800° F., passed through heat exchanger 116 where it is cooled to a temperature on the order of from about 500° to about 700° F., and then passed through line 126 into solvent hydrogenation hot separator 127. An overhead gas stream is withdrawn from this separator at a temperature of from about 600° to about 700° F. through line 128 and thereafter cooled to substantially room temperature in heat exchanger 130. The cooled gas is then introduced into solvent hydrogenation cold separator 131 where residual hydrocarbon liquids and sour water are removed. The two separators will normally be operated at pressures between about 1500 and about 2000 psig. The liquids separated from the hydrogenated effluent in hot solvent hydrogenation separator 127 are withdrawn through line 132 containing pressure reduction valve 133 and combined with residual liquid hydrocarbons withdrawn from the solvent hydrogenation cold separator 131 through line 134 containing pressure reduction valve 135. The combined liquid stream is then passed through line 136 to the solvent hydrogenation fractionation unit. Sour water from the solvent hydrogenation cold separator is withdrawn through line 137 and passed to water cleanup facilities not shown in the drawing.

The gas stream recovered from the solvent hydrogenation cold separator 131 is taken overhead through line 140. This gas stream will consist primarily of hydrogen and normally gaseous hydrocarbons but will also contain some naphtha boiling range constituents, traces of higher hydrocarbons, and contaminants such as carbon monoxide, carbon dioxide, ammonia, hydrogen chloride, and hydrogen sulfide. The recovered gas passes from line 140 into water scrubber 141 where it is contacted with water introduced through line 142 for the removal of ammonia, hydrogen chloride and other water soluble constituents. Water containing the materials removed from the gas is withdrawn through line 143 and sent to water cleanup facilities not shown. The scrubbed gas, still containing carbon dioxide and hydrogen sulfide, is taken overhead through line 144 to solvent scrubber 145. Here the gas is contacted with monoethanolamine, diethanolamine or a similar solvent introduced through line 146 for the removal of acid gases. Spent solvent is taken off through line 147 and passed to a solvent recovery unit which will normally include facilities for the recovery of sulfur. The scrubbed gas, now composed primarily of hydrogen and normally gaseous hydrocarbons with some carbon monoxide and very small amount of naphtha boiling range hydrocarbons, passes through line 148 to recycle gas compressor 149 where it is compressed to a pressure sufficient to permit its recycle to the liquefaction stage of the operation. Pressures on the order from about 2500 psig to 3000 psig will normally be used. The compressed gas flows through line 150 and is injected into the cold-solvent slurry feed stream, either through line 18 containing valve 19 or line 15 containing valve 22.

The gas stream recycled from the solvent scrubber through lines 148 and 150 to the liquefaction stage of the process will normally be composed primarily of hydrogen but will contain methane and other low molecular weight hydrocarbons and small amounts of carbon monoxide, carbon dioxide and hydrogen sulfide. Because of the relatively high hydrogen content, no makeup hydrogen need be added to the recycle stream. To prevent the buildup of light hydrocarbons and contaminants and thus maintain treat gas hydrogen purity, a purge is taken through line 151. The volume of gas purged will depend to some extent upon the operating conditions, the composition of the feed coal, the efficiency of the scrubbing operation, the type of quench used in the solvent hydrogenation zone, and other factors but in general it is advantageous to purge from about 20 to about 35 volume percent of the gas taken overhead from the solvent scrubber. The purged gas may be employed as a fuel, used as a source of hydrogen and normally gaseous hydrocarbons, or employed for other purposes. If a liquid quench is used, valve 177 in line 178 will normally be closed and compressor 179 and line 125 will not be used.

If the process is to be carried out with a liquid quench, the liquids recovered from the solvent hydrogenation hot and cold separators are fed through line 136 to final fractionator preheat furnace 152. Here the liquids are heated from a temperature a little below the solvent hydrogenation hot separator temperature to a higher temperature, normally between about 700° and about 750° F., and then passed through line 153 into final fractionator 154. The feed to the fractionator will contain hydrogen, normal gaseous hydrocarbons, liquid hydrocarbons boiling up to about 1000° F., and small amounts of acid gas constituents and other contaminants. This feed stream is fractionated to produce an overhead product composed primarily of gases and naphtha boiling range hydrocarbons which is taken off through line 155, cooled in heat exchanger 156, and introduced through line 157 into distillate drum 158. The off gases withdrawn through line 159 will be composed primarily of hydrogen and normally gaseous hydrocarbons but will include some liquid constituents in the naphtha boiling range. This stream can be used as a fuel or employed for other purposes. The liquid stream from drum 158, composed primarily of naphtha boiling range materials, is in part returned to the fractionator through line 160 and in part recovered as naphtha product through line 161. A stream of sour water is also withdrawn from the distillate drum through line 162 and sent to water cleanup facilities.

One or more side streams boiling above the naphtha range are recovered from fractionator 154. In the particular installation shown in the drawing, a first side stream composed primarily of hydrocarbons boiling up to about 700° F. is taken off through line 163 into stripper 164, the overhead fraction is returned through line 165, and the remaining liquids are withdrawn through line 166. A second side stream composed primarily of hydrocarbons boiling below about 850° F. is withdrawn from the fractionator through line 167 into stripper 168, a portion is returned through line 169, and the remainder is withdrawn through line 170. A bottoms stream composed primarily of hydrocarbons boiling below about 1000° F. is withdrawn from the fractionator through line 171. These three streams may in part be combined and, if the net liquefaction product has not been withdrawn earlier as product from fractionators 38 and 61, may be withdrawn through line 172 as coal liquids product. The remainder of the two sidestreams is withdrawn through lines 173 and 174, passed through heat exchanger 175, and recycled through lines 176 and 12 to the solvent-coal slurry preparation zone 11 for use in preparing the slurry fed to the liquefaction stage of the process. Heat exchanger 175 can be omitted if desired. In the heat exchanger, if utilized heat will be recovered from the hot recycle solvent stream and the solvent will normally be cooled to a temperature between about 100° and about 200° F.

The liquid quench employed in the solvent hydrogenation zone is provided by passing at least a portion of the bottoms stream from fractionator 154 through line 182 containing valve 183, through heat exchanger 184, and through line 124 into line 122 between the two solvent hydrogenation zone stages. This stream will normally be cooled in the exchanger from the fractionator bottoms temperature of from about 650° to 750° F. to a temperature between about 350° and about 500° F. before it is introduced into line 122. This use of a high temperature bottoms stream which boils above the solvent boiling range and can readily be cooled to an optimum temperature for quench purposes is particularly advantageous and permits avoidance of overhydrogenation and other difficulties that may be encountered in processes where other methods for controlling the exothermic solvent hydrogenation reaction are employed. If desired, however, a mixture of bottoms and lower boiling liquid from one or more of the sidestreams from fractionator 154 can in some cases also be used.

If a gaseous quench is to be used in the process, the valve 183 will normally be closed and a portion of the gas taken overhead from the solvent scrubber 145 through line 148 will be withdrawn through line 178, raised to the solvent hydrogenation pressure by means of compressor 179, and injected through line 125 into line 122 between the two solvent hydrogenation zone stages. This use of a gaseous quench simplifies mixing of the quench stream with the liquids between the two stages, results in better distribution of the quench fluid, aids in avoiding nonuniform hydrogenation, and has safety and control advantages. These advantages may in some cases outweight those associated with the use of a liquid quench but in most instances a liquid quench will be preferred.

In the system shown in the drawing, the liquids from the hot and cold solvent hydrogenation separators are preheated in furnace 152 and then fractionated in fractionator 154 equipped with sidestream strippers 164 and 168. If a gaseous quench is used and sidestreams boiling above the naphtha boiling range are not required, the equipment employed in the process can be simplified by passing the separator liquids from line 136 through line 185 containing valve 186, thus bypassing furnace 152, and operating tower 154 as a stripping unit, thus eliminating the sidestream strippers. Gases and naphtha will be taken overhead from the tower through line 155 and the remaining liquids will be withdrawn through line 171 as a bottoms stream. This bottoms stream can be passed through line 172 and line 187 containing valve 188 for recycle through line 173 to the slurry preparation zone. If the net liquid products have not been recovered earlier from the atmospheric or vacuum fractionator, a portion of this stream can also be withdrawn as coal liquids product.

We claim:

1. A process for the production of liquid hydrocarbons from coal or similar liquefiable carbonaceous solids which comprises contacting said carbonaceous solids with a hydrogen-donor solvent and molecular hydrogen under liquefaction conditions in a liquefaction zone to produce a liquefaction effluent; separating said liquefaction effluent into a hot vapor stream and a liquid stream; recovering coal liquids in the solvent boiling range from said liquid stream; cooling said hot vapor stream sufficiently to condense vaporized normally liquid hydrocarbons from the vapor; separating condensed normally liquid hydrocarbons from the cooled vapor; mixing said coal liquids in the solvent boiling range with the cooled vapor and with makeup hydrogen to form a solvent hydrogenation feed stream; passing said solvent hydrogenation feed stream to a catalytic solvent hydrogenation zone maintained under solvent hydrogenation conditions; recovering a hydrogenated effluent from said solvent hydrogenation zone; separating said hydrogenated effluent into a vaporous fraction containing molecular hydrogen and a liquids fraction; recycling a portion of said vaporous fraction including molecular hydrogen and at least a portion of said liquids fraction to said liquefaction zone; purging a portion of said vaporous fraction; and recycling fluid separated from sAid hydrogenated effluent to said solvent hydrogenation zone as a quench.

2. A process as defined by claim 1 wherein said fluid separated from said hydrogenated effluent comprises a portion of said vaporous fraction.

3. A process as defined by claim 1 wherein said fluid separated from said hydrogenated effluent comprises a portion of said liquids fraction.

4. A process as defined by claim 1 wherein said hot vapor stream is cooled to a temperature from about 50° to about 200° F. below the liquefaction temperature.

5. A process as defined by claim 1 wherein from about 5 to about 25% of said total hot vapor stream is separated from said cooled vapor as condensed liquid hydrocarbons.

6. A process as defined by claim 1 wherein said normally liquid hydrocarbons comprises hydrocarbons boiling between about 450° and about 850° F.

7. A process as defined by claim 1 wherein from about 20 to about 35% by volume of said vaporous fraction is purged.

8. A process as defined by claim 1 wherein said makeup hydrogen is mixed with said cooled vapor in a ratio of from about 0.5 to about 1.5 moles of vapor per mole of makeup hydrogen.

9. A process as defined by claim 1 wherein said hot vapor stream has a temperature between about 700° and about 900° F.

10. A process as defined by claim 1 wherein said fluid separated from said hydrogenated effluent comprises a bottoms stream composed primarily of hydrocarbons boiling below about 1000° F.

* * * * *